United States Patent [19]

Haas

[11] Patent Number: 4,815,246

[45] Date of Patent: Mar. 28, 1989

[54] SLIDING DOOR

[75] Inventor: Fred Haas, Unionville, Canada

[73] Assignee: Viceroy Homes Limited, Scarborough, Canada

[21] Appl. No.: 203,557

[22] Filed: Jun. 1, 1988

Related U.S. Application Data

[63] Continuation of Ser. No. 047,270, May 8, 1987, abandoned.

[30] Foreign Application Priority Data

Aug. 28, 1986 [CA] Canada ..... 517039

[51] Int. Cl.[4] ..... L05D 13/02

[52] U.S. Cl. ..... 52/207; 52/775; 49/404; 49/501

[58] Field of Search ..... 52/207, 775, 773; 49/DIG. 2, 404, 501, 504

[56] References Cited

U.S. PATENT DOCUMENTS

| | | | |
|---|---|---|---|
| 2,067,118 | 1/1937 | Guse | 49/406 |
| 2,847,726 | 8/1958 | Frick | 52/207 |
| 3,383,801 | 5/1968 | Pallaire | 49/458 |
| 3,859,754 | 1/1975 | Budich et al. | 49/504 X |
| 4,040,219 | 8/1977 | Budich | 52/775 |
| 4,073,097 | 2/1978 | Jentoft et al. | 52/200 X |
| 4,123,883 | 11/1978 | Barber, Jr. et al. | 52/200 |
| 4,319,430 | 3/1982 | Menard | 52/207 |
| 4,388,784 | 6/1983 | Jentoft et al. | 52/200 |
| 4,398,373 | 8/1983 | Mancuso | 49/425 |
| 4,409,767 | 10/1983 | Jentoft et al. | 52/200 |
| 4,420,907 | 12/1983 | Swan | 49/404 X |
| 4,449,340 | 5/1982 | Jentoft et al. | 52/200 |
| 4,473,799 | 10/1984 | Bruhm | 52/200 |
| 4,524,112 | 6/1985 | Willert | 49/504 |
| 4,554,770 | 11/1985 | Anders | 52/207 |
| 4,580,366 | 4/1986 | Hardy | 49/406 |
| 4,640,061 | 2/1987 | Trumley | 52/71 |
| 4,674,246 | 6/1987 | Giguere | 52/207 |

FOREIGN PATENT DOCUMENTS

| | | | |
|---|---|---|---|
| 2729287 | 1/1979 | Fed. Rep. of Germany | 49/504 |
| 2800881 | 7/1979 | Fed. Rep. of Germany | 49/504 |
| 3009344 | 7/1981 | Fed. Rep. of Germany | 52/200 |
| 2036158 | 12/1970 | France | 52/200 |
| 2393126 | 2/1979 | France | 52/200 |
| 355927 | 9/1961 | Switzerland | 49/401 |
| 1210410 | 10/1970 | United Kingdom | 49/504 |
| 2179693 | 3/1987 | United Kingdom | 49/504 |

*Primary Examiner*—Henry E. Raduazo

[57] ABSTRACT

A sliding door having sliding and fixed door panels with extruded top, bottom and side sections all of an identical first extrusion, and joined at corners to form a rectangular frame, the first extrusion having an interior rectangular closed box portion with side walls and end walls, inner and outer facing walls located in spaced parallel relation from the side walls of the box portion, junction walls extending between the side walls of the box portion, and the inner and outer facing walls, and glass retaining formations connected with the inner and outer facing walls, and having door jambs and an upper cross member formed of an identical second extrusion which defines a receiving channel for the sliding door panel, and having a lower threshold defining a top wall and rail registering with the receiving channel.

2 Claims, 3 Drawing Sheets

SLIDING DOOR

This application is continuation of application Ser. No. 047,270, filed May 8, 1987, now abandoned.

The invention relates to a sliding door, having a door frame and jambs and upper cross member formed of extruded thermoplastic.

BACKGROUND OF THE INVENTION

Sliding doors are usually of two-part construction with one door panel being fixed and the other door panel sliding relative to it. Such doors are in wide-scale use for residential and commercial construction. The door panels are usually frames, glazed, preferably with thermal glass panels. The frames are also required to have a degree of thermal efficiency at least equal to that of the glazing and preferably higher.

Various designs have been proposed and have been in considerable usage in the past, employing extruded plastic material such as vinyl plastics. Extrusions are also in wide use for the door jambs and cross frames.

The use of such extruded plastic material is attractive from the viewpoint of economy, and also since they may be extruded in various colours, and are resistant to weather damage and the suns rays, and also have a low thermal conductivity. However, they do have certain disadvantages. In the first place, the past extrusions have been of relatively simple cross-section. Such extrusions have often had insufficient strength to carry the weight of a heavy glass panel in a full size sliding door, and have been subject to warping or bending.

In addition, the provision of a good air seal between the door frame and the door jambs has not always been satisfactory in the past.

Furthermore, the system for glazing the door frame did not always readily permit replacement of broken glass panels, and did not always provide for an adequate seal between the glass panel and the frame.

BRIEF SUMMARY OF THE INVENTION

With a view to providing an improved sliding door the invention comprises a sliding door having a door frame having extruded top and bottom sections and extruded side sections all being formed of an identical first extrusion, and joined at corners to form a rectangular frame, said extrusion defining an interior generally rectangular closed box portion having side walls and inner and outer end walls, inner and outer facing walls located in spaced parallel relation from the inner and outer walls of said box member, junction walls extending between said inner and outer walls of said box member and said inner and outer facing walls, and glass retaining means being connected with said inner and outer facing walls, and with said box member, and having parallel door jambs and an upper cross member formed of an identical second extrusion.

More particularly, the invention comprises such a door, wherein said inner facing member of said first extrusion is of a predetermined first length, and said outer facing member is of a predetermined second length, and a glass supporting ledge portion connected with said inner facing wall, for receiving a glass panel thereon, and including glass retaining channel means associated with said outer facing wall, and a glass retaining strip member removably insertable into said retaining means associated with said outer wall.

More particularly, the invention comprises such a sliding door including a generally rectangular metallic insert member in said box member.

More particularly it is an object of the invention to provide such a sliding door, and including a removable glass retaining strip engageable with the side members and top and bottom members.

More particularly, the invention comprises such a door and having a lower threshold panel formed of metal and defining spaced apart parallel channels registering with said spaced apart parallel channels in said door jambs and cross member.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
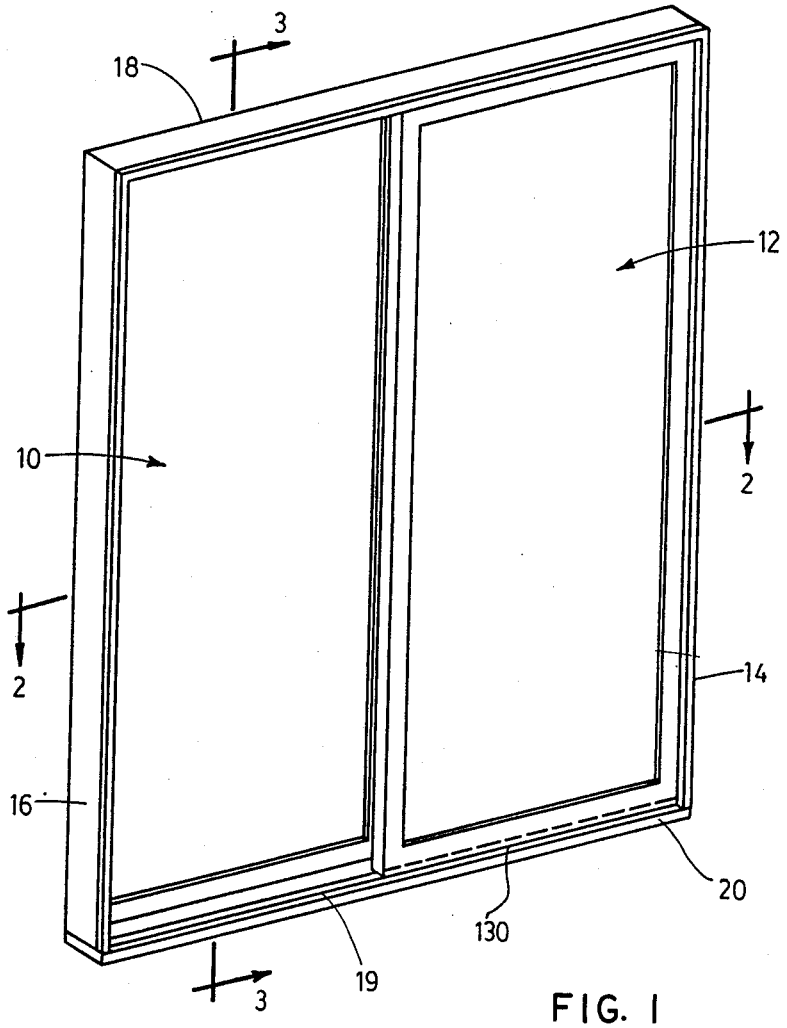
FIG. 1 is a perspective illustration of a sliding door according to the invention.

Referring now to the illustrations, it will be seen that FIG. 1 illustrates the invention in the form of a sliding door typically used for example in domestic construction leading from a home onto a patio, garden, or the like.

It will of course be appreciated, however, that such sliding doors are not limited to any such application. They may be used in any application where a sliding door is required, whether inside a building, or on the exterior of a building, or whether of domestic or commercial use or the like. Such doors may conceivably be used on portable or mobile buildings if desired, or on very large vehicles. It will thus be understood that while the door is described in relation to one form of construction, its use and application is to be considered as if in any application where doors are required.

As best shown in FIG. 1, the door comprises a sliding door panel 10, a fixed door panel 12, mounted in a doorway comprising door jambs 14 and 16, and an upper door cross member 18, and a door threshold 19.

Figure 2:
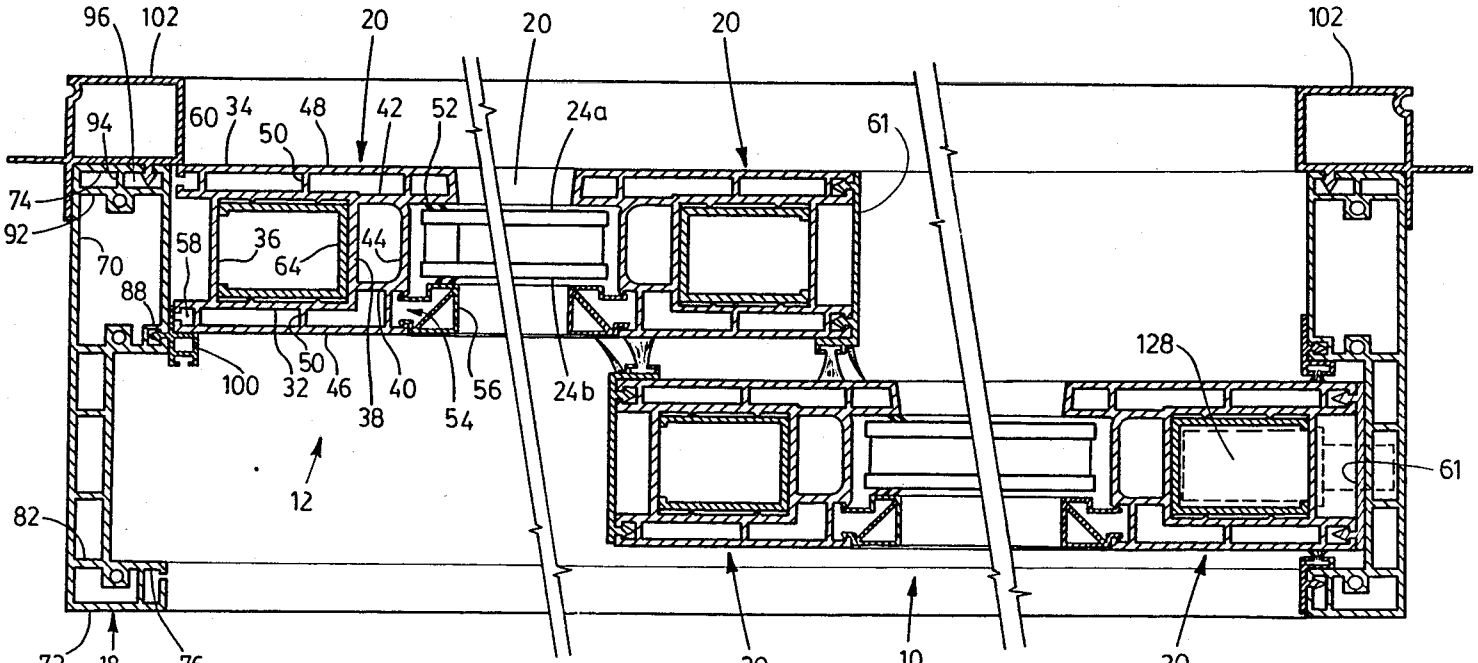
FIG. 2 is a horizontal section along the line 2—2 of FIG. 1.
Figure 3:
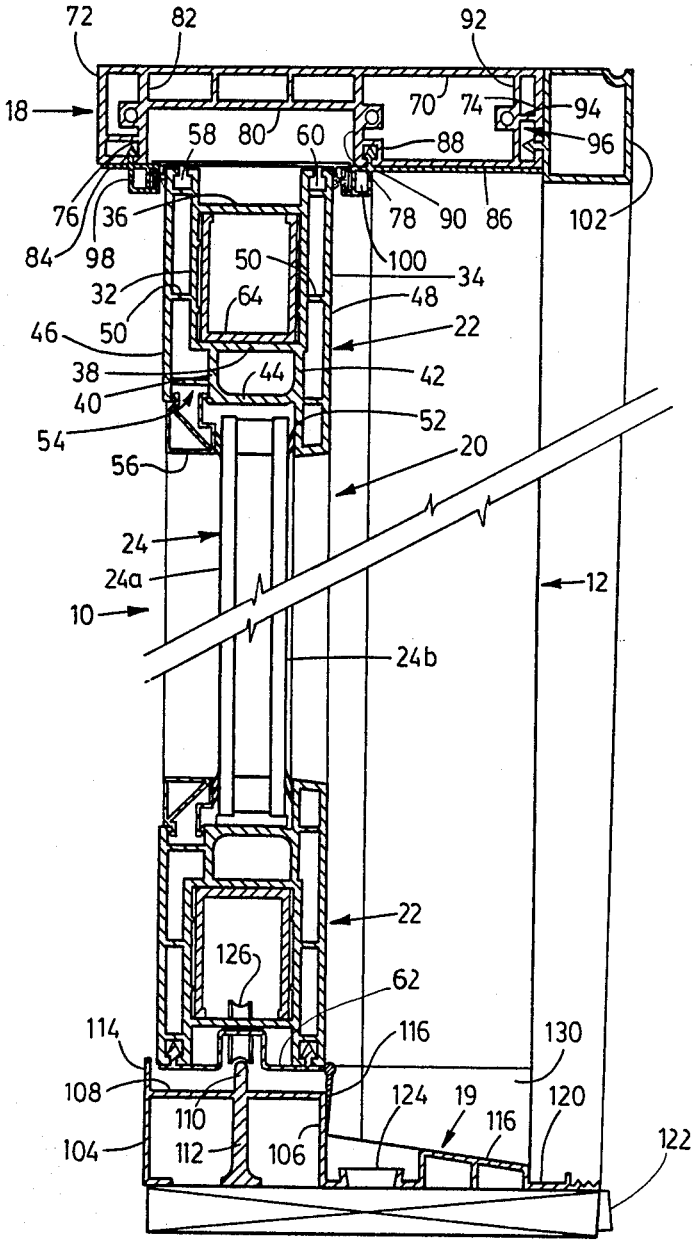
FIG. 3 is a vertical section along the line 3—3 of FIG. 1.

Referring now to FIGS. 2 and 3, it will be noted that the door panels 10 and 12 comprise door side frames 20 and door upper and loer frames 22. All of the door frame portions, whether side frames or top and bottom frames on both panels 10 and 12 are formed of an identical extrusion typically being formed of extruded vinyl plastic material.

Each of door panels 10 and 12 include glazing in the form of a glass panel 24. As illustrated, the glass panel 24 consists of two spaced apart glass panes **24*a*, 24*b***, being formed in a manner well known in the art as a sealed glass thermal panel. Other materials such as plastics may also be used.

While only two such glass sheets are shown, it is well known that more such glass sheets may be provided to provide a greater thermal barrier. Conceivably, however, if such sliding door is used in a situation where the thermal conductivity is not a problem, then a single panel or sheet of glass could be used.

As shown in FIGS. 2, 3 the extrusion of the door frame comprises a main or inner four-sided box member comprising side walls 32, 34, and end walls 36, 38, which are all extruded as a single intergral four-sided box-like structure.

A side channel comprising side walls 40 and 42, and end wall 44, is extruded integrally with the end wall 38.

Inner and outer facing walls 46 and 48 are formed in parallel spaced apart planes and are joined to respective side walls 32, 34 and 40, 42 by means of intermediate spaced apart junction walls 50 and define tubular enclosures.

The outer facing wall 48, and the side wall 42 are extended beyond the limits of end wall 44, to provide a ledge portion 52, against which the glass panel 24 may be laid for glazing.

The inner facing wall 46 and the channel side wall 40 together define a retaining channel 54. Channel 54 receives a retaining strip 56, adapted to abut on the inwardly facing surface of the glass panel 24.

Suitable seals (well known in the art) are provided on either side of the glass panel.

At the opposite ends of walls 46 and 48, there are provided further retaining channels 58 and 60. Channels 58 and 60 may be left empty, as shown in the upper portion of FIG. 3, or may be used to retain a trim strip 61 (FIG. 2) or 62 illustrated in the lower part of FIG. 3.

A metallic reinforcing channel 64 may be inserted lengthwise along the main box member defined by the walls 32, 34, 36 and 38 to provide additional rigidity.

It will be appreciated that all four sides of the door frame, for both doors, are constructed of the extrusion as illustrated and described herein.

The extrusions are joined at mitered corners by welding in a manner well known in the art to provide a rectangular frame.

As noted above, each of the doors is mounted between the two door jambs, and the cross member, and the threshold.

The door jambs 14 and 16 and the upper cross member 18 are all formed of a common thermoplastic extrusion (typically a vinyl plastic), illustrated in FIGS. 2 and 3. It comprises a continuous base wall 70, and inner and outer side walls 72, 74. An inner generally three-sided rectangular channel track is formed by the channel side walls 76, 78, and the channel bottom wall 80. The channel walls 76, 78 and 80 are connected to the base wall 70 by means of junction walls 82 and defining a tubular enclosure.

Side walls 72 and 76 are turned inwardly, and define a retaining channel 84. Between the side walls 74 and 78, a facing wall 86 extends, substantially in the same plane as the extremities of walls 78, 76 and 74 and defining a tubular enclosure. Facing wall 86 provides a door locating surface for the fixed outer door 12. At the junction between walls 86 and 78, a generally L-shaped bracing wall 88 is provided, and an opening is provided in wall 86 defining a retaining channel 90.

Between wall 86 an 70, a bracing wall 92 is provided and a T-shaped bracing wall 94 connects wall 92 with wall 72. At the junction of walls 86 and 72, an opening defines a retaining channel 96.

Retaining strips 98 and 100 may be fastened in the retaining channels 84 and 90.

An outer door jamb trim strip 102 may be attached to retaining channel 96.

The door theshold 19 (FIG. 3) comprises a generally three-sided inverted channel having side walls 104–106, and a top wall 108. A central rail 110 extends upwardly from wall 108, and is supported beneath by a pedestal wall 112. The lower edges of walls 104, 106 and pedestal 112 lie in a common plane, so that they may lie on the fabric of the building structure.

An inner flange 114 extends upwardly from wall 104, to conceal the lower edge of the door frame. An outer flexible sealing strip 116 is fastened to the outside of wall 106, and rides on the exterior of the door frame.

A sloping flashing wall 116 extends from a point midway down wall 106, and is angled outwardly and downwardly, whereby to shed water and the like to the exterior of the building. It is provided with supporting flanges 118, and terminates in a flat planar strip 120 lying in the same plane as the lower edges of wall 104 and 106. A generally L-shaped edge flange 122 extends over the edge of the building fabric.

Fastening holes 124 may be provided at intervals.

As has been described above, in the typical sliding door installation, one of the door panels is fixed and the other one slides to and fro. In order to do this the two door panels must be mounted offset from one another so that one door panel may slide beside the other.

In order to permit sliding, the sliding door panel 10 (FIG. 3) will have a plurality of rollers 126 mounted along its underside, and secured therein by means of the cover strip 62. Suitable openings (not shown) in wall 36 will be cut to permit the wheels to extend therethrough. Rollers 126 ride on rail 110 supported by pedestal wall 112.

The sliding door 10 may also be provided with any suitable form of lock, illustrated only in phantom, in FIG. 2 as 128. The lock 128 is designed to be recieved within the metal reinforcing channel 64 in the main box frame 32, 34, 36 and 38.

Any suitable form of lock operating mechanism (not shown) such as is well known in the art may be provided for operating the lock 128.

The fixed door 12 will be secured between the one door jamb 16, the door cross-member 18, and the threshold 19. Since the dimensions of the two doors are 10 and 12 are the same (in this embodiment) it will be noted that the lower edge of the door 12 will register with the flashing wall 116. Since it cannot sit directly on this wall, a filler strip 130 is provided in this embodiment, which may be fastened in position on the flashing wall 116, and will support the door 12 at the appropriate height.

Suitable wipers and seals are provided where shown, to ensure a good weather tight operation.

It will thus be seen that the invention provides a rigid and effective door frame, and door jambs and cross-members, and threshold. Typically the threshold 19 will be formed of aluminum material, and the remaining components will be formed of extruded vinyl plastic material.

It will be seen that when assembled the doors will have a very high degree of rigidity, and will be entirely weather resistant, and will provide a high degree of resistance to corrosion and wear, and will also provide a protective thermal barrier.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A sliding door of the type having a sliding door panel and a fixed door panel and comprising:

said sliding door panel and said fixed door panel having top and bottom frame portions and side frame portions formed of an identical first extrusion, and joined at corners to form a rectangular frame, said first extrusion in turn defining:

an interior generally rectangular closed box portion having side walls and end walls;

inner and outer facing walls located in spaced parallel relation from said side walls of said box member;

junction walls extending between said side walls of said box member and said inner and outer facing walls, said inner and outer facing walls and said junction walls defining tubular enclosures around the exterior of said side and end walls of said inner box portion;

a side channel defined by channel side and end walls formed along said inner box member;

a tubular ledge portion defined by an extension of said outer facing wall and one of said side walls;

a retaining channel connected to said inner facing wall;

a retaining strip received in said retaining channel for retaining glazing between said retaining strip and said ledge portion;

and said sliding door further comprising two parallel spaced apart door jambs and an upper cross member formed of an identical second extrusion, said second extrusion, in turn, defining:

a channel bottom wall and channel side walls forming a receiving channel for said sliding door panel;

a base wall spaced therefrom;

junction walls extending between said base wall and said channel bottom wall and defining tubular enclosures extending along said channel bottom wall;

a fixed door locating facing wall parallel to said receiving channel;

said fixed door locating facing wall and said base wall defining a tubular enclosure parallel to said receiving channel;

a door threshold panel formed of metal and defining a top wall registering with said receiving channel in said door jambs and cross member;

a flashing wall extending outwardly from said top wall;

a rail formed along said top wall, in registration with said receiving channel;

roller means on said sliding door panel, engaging and riding on said rail, and, a filler strip supported on said flashing wall for supporting a fixed door panel.

2. A sliding door as claimed in claim 1 including a generally rectangular metallic insert member in said box member of said first extrusion.

* * * * *